US012691319B2

(12) United States Patent
Tsai

(10) Patent No.: US 12,691,319 B2
(45) Date of Patent: Jul. 28, 2026

(54) FRAME-TYPE LEG LIFT MACHINE OPERATED SAFELY AND HAVING STEADY SWINGING ACTION

(71) Applicant: Yu-Lun Tsai, Taichung (TW)

(72) Inventor: Yu-Lun Tsai, Taichung (TW)

( * ) Notice: Subject to any disclaimer, the term of this patent is extended or adjusted under 35 U.S.C. 154(b) by 0 days.

(21) Appl. No.: 18/626,446

(22) Filed: Apr. 4, 2024

(65) Prior Publication Data

US 2025/0312639 A1 Oct. 9, 2025

(51) Int. Cl.
*A63B 21/00* (2006.01)
*A63B 23/035* (2006.01)

(52) U.S. Cl.
CPC ..... *A63B 21/00192* (2013.01); *A63B 21/159* (2013.01); *A63B 21/4034* (2015.10); *A63B 21/4035* (2015.10); *A63B 21/4045* (2015.10); *A63B 23/0355* (2013.01)

(58) Field of Classification Search
CPC ..... A63B 21/00192; A63B 21/005; A63B 21/151; A63B 21/159; A63B 21/225; A63B 21/4034; A63B 21/4035; A63B 21/4045; A63B 21/4047; A63B 22/0048; A63B 22/0056; A63B 22/0058; A63B 2022/0051; A63B 2022/0053; A63B 23/0355; A63B 23/03575
See application file for complete search history.

(56) References Cited

U.S. PATENT DOCUMENTS 6,036,622 A * 3/2000 Gordon ..... A63B 22/001 482/70
9,539,464 B1 * 1/2017 Liu ..... A63B 69/0057
12,337,203 B1 * 6/2025 Tsai ..... A63B 21/159
2007/0117684 A1 * 5/2007 Liao ..... A63B 22/0664 482/52
2007/0117685 A1 * 5/2007 Liao ..... A63B 21/225 482/52
2007/0117686 A1 * 5/2007 Liao ..... A63B 22/04 482/52
2009/0005222 A1 * 1/2009 Liao ..... A63B 22/001 482/52
2010/0093498 A1 * 4/2010 Fenster ..... A63B 24/00 482/52

(Continued)

FOREIGN PATENT DOCUMENTS

AU 2010100109 A4 * 3/2010 ..... A63B 22/0664

*Primary Examiner* — Gary D Urbiel Goldner
(74) *Attorney, Agent, or Firm* — Chun-Ming Shih; LANWAY IPR SERVICES

(57) ABSTRACT

A frame-type leg lift machine includes a main frame unit, two drive levers, two pedals, two handlebars, two transverse driven levers, two first driven levers, two rear swinging members, a swinging mechanism, and a magnetically controlled resistance mechanism. Each of the two pedals is pivotally mounted on a lower end of one of the two drive levers. Each of the two drive levers has an upper end linking one of the two transverse driven levers to drive each of the two handlebars and linking one of the two first driven levers and one of the two rear swinging members to drive the swinging mechanism. The swinging mechanism is linked to the magnetically controlled resistance mechanism which feeds back a resistance to the two drive levers and the two handlebars.

10 Claims, 10 Drawing Sheets

(56) References Cited

U.S. PATENT DOCUMENTS

| | | | | |
|---|---|---|---|---|
| 2010/0137111 | A1* | 6/2010 | Van Handel | A63B 22/001 482/52 |
| 2011/0039662 | A1* | 2/2011 | Gordon | A63B 22/0664 482/52 |
| 2012/0077645 | A1* | 3/2012 | Lee | A63B 22/0664 482/52 |
| 2012/0100963 | A1* | 4/2012 | Gordon | A63B 22/02 482/52 |
| 2013/0178339 | A1* | 7/2013 | Gordon | A63B 22/04 482/51 |
| 2015/0202489 | A1* | 7/2015 | Gordon | A63B 22/0292 482/53 |
| 2016/0263433 | A1* | 9/2016 | Wu | A63B 22/0015 |
| 2017/0106231 | A1* | 4/2017 | Liao | A63B 69/0057 |
| 2017/0252604 | A1* | 9/2017 | Gordon | A63B 22/0017 |
| 2018/0036582 | A1* | 2/2018 | Liao | A63B 22/0664 |
| 2018/0221708 | A1* | 8/2018 | Gordon | A63B 22/0017 |
| 2022/0111246 | A1* | 4/2022 | Ellis | A63B 22/205 |
| 2022/0203158 | A1* | 6/2022 | Tholkes | A63B 23/035 |
| 2025/0205538 | A1* | 6/2025 | Tsai | A63B 23/04 |
| 2025/0205539 | A1* | 6/2025 | Tsai | A63B 21/00192 |
| 2025/0205548 | A1* | 6/2025 | Tsai | A63B 21/159 |

* cited by examiner

FRAME-TYPE LEG LIFT MACHINE OPERATED SAFELY AND HAVING STEADY SWINGING ACTION

BACKGROUND OF THE INVENTION

Field of the Invention

The present invention relates to an exercising machine and, more particularly, to a frame-type leg lift (or raise or extension) machine with magnetically controlled resistance.

Description of the Related Art

A conventional leg lift machine generally comprises a square-shaped main frame unit, two driving levers, and at least one linkage. The main frame unit includes a bottom frame, an upper support frame, a handgrip frame mounted on the upper support frame, two front vertical frames connected between the front end of the bottom frame and the upper support frame, and two rear vertical frames connected between the rear end of the bottom frame and the upper support frame. Each of the two driving levers has a lower end pivotally connected with a pedal and an upper end pivotally mounted on one of the two rear vertical frames. The at least one linkage has a first end pivotally connected with the upper end of one of the two driving levers and a second end pivotally mounted on the main frame unit.

However, the conventional leg lift machine has the following disadvantages.

1. The structure of the two driving levers and the linkage is simplified, so that the two driving levers and the linkage are not operated smoothly and steadily, and cannot meet the market demand of professional gyms.

2. The linkage is exposed outward so that the user easily touches the linkage, thereby greatly causing danger to the user or other person passing by the linkage.

BRIEF SUMMARY OF THE INVENTION

The primary objective of the present invention is to provide a frame-type leg lift machine that is operated safely and has steady swinging action.

In accordance with the present invention, there is provided a leg lift machine comprising a main frame unit, two drive levers, two pedals, two handlebars, two transverse driven levers, two first driven levers, two rear swinging members, a swinging mechanism, and a magnetically controlled resistance mechanism. The main frame unit includes a bottom frame, two side brackets, two front uprights, and two rear uprights. Each of the two front uprights is connected with the bottom frame and a front end of one of the two side brackets. Each of the two rear uprights is connected with the bottom frame and a rear end of one of the two side brackets. Each of the two drive levers has an upper end provided with a pivot portion extending outward. The upper end of each of the two drive levers is pivotally mounted on one of the two rear uprights. The upper end of each of the two drive levers is served as a rotation fulcrum, and the two drive levers are pivoted relative to the main frame unit, reciprocally swing forward and backward, and move along a curved trajectory. Each of the two pedals is pivotally mounted on a lower end of one of the two drive levers. Each of the two handlebars has a lower end pivotally mounted on the bottom frame. Each of the two transverse driven levers has a first end pivotally connected with a mediate section of one of the two handlebars and a second end pivotally connected with the pivot portion of one of the two drive levers. Each of the two first driven levers has an upper end pivotally connected with the pivot portion of one of the two drive levers. Each of the two rear swinging members is pivotally mounted on one of the two rear uprights. Each of the two rear swinging members has a first end pivotally connected with a lower end of one of the two first driven levers. The swinging mechanism includes a transverse swinging seat, two linking members, two bottom levers, two front swinging members, and a rotation mandrel. The transverse swinging seat is swingably and pivotally mounted on a rear section of the bottom frame. Each of the two linking members has a first end pivotally connected with one of two ends of the transverse swinging seat and a second end pivotally connected with one of the two rear swinging members. Each of the two bottom levers has a rear end pivotally connected with a second end of one of the two rear swinging members. Each of the two front swinging members has a first end pivotally connected with a front end of one of the two bottom levers and a second end mounted on the rotation mandrel. The magnetically controlled resistance mechanism is mounted on a front section of the bottom frame and linked to the swinging mechanism to provide a resistance to the swinging mechanism. The magnetically controlled resistance mechanism at least includes a magnetically controlled wheel that is rotatable, a pivot wheel mounted on a shaft of the magnetically controlled wheel, and a transmission belt mounted around the pivot wheel and the rotation mandrel.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
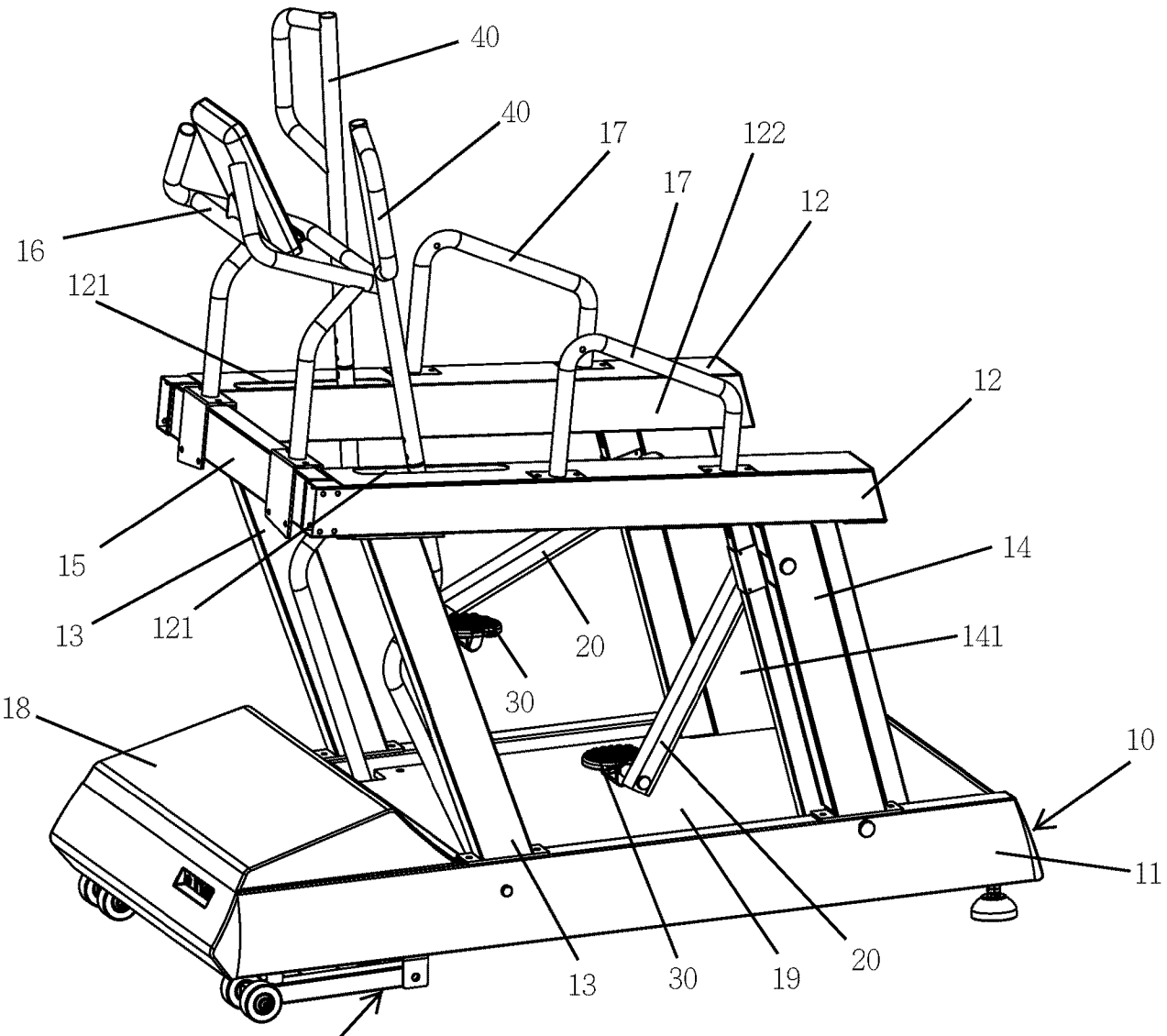
FIG. 1 is a perspective view of a leg lift machine in accordance with the preferred embodiment of the present invention.
Figure 2:
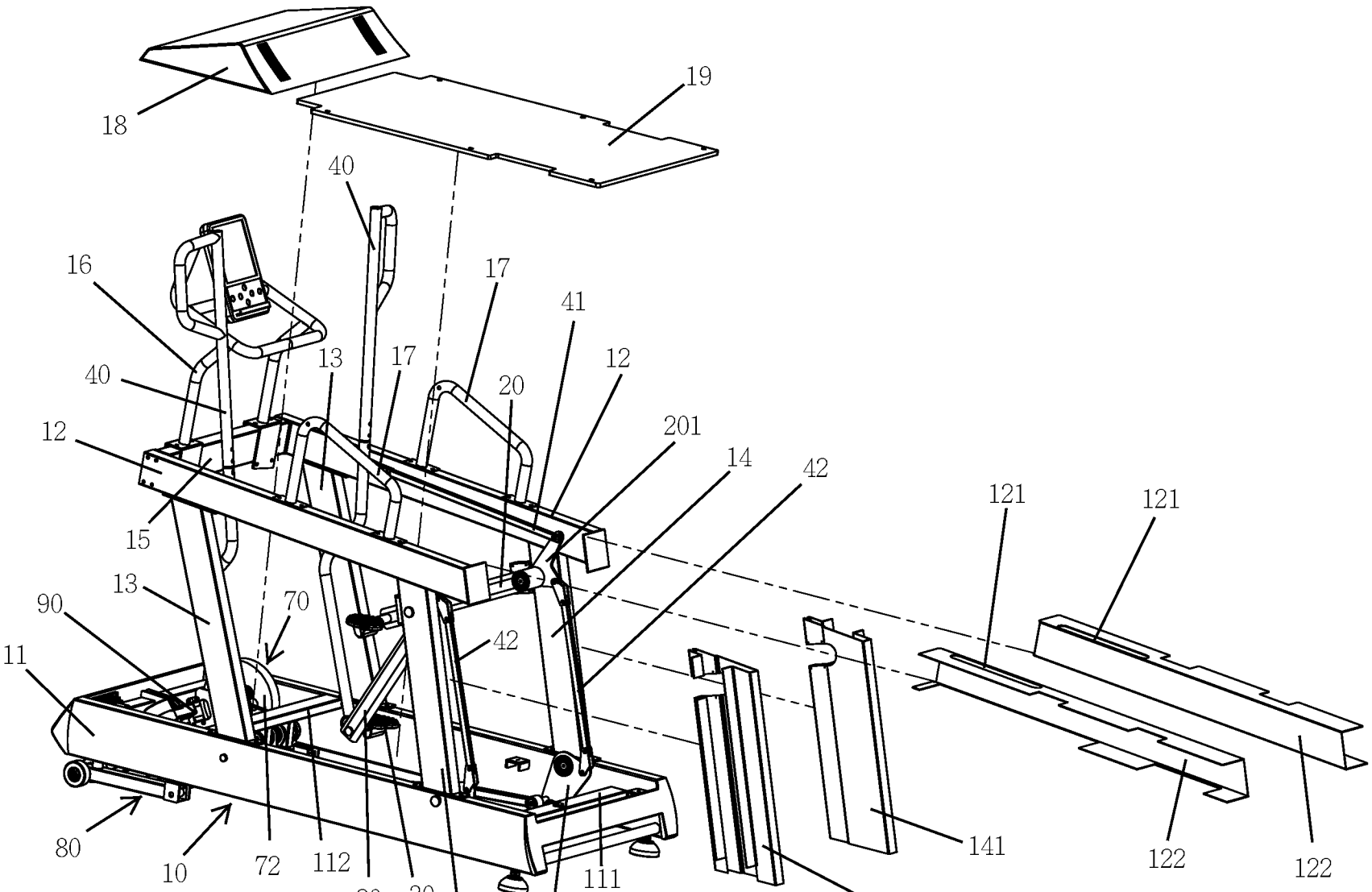
FIG. 2 is a partial exploded perspective view of the leg lift machine in accordance with the preferred embodiment of the present invention.
Figure 3:
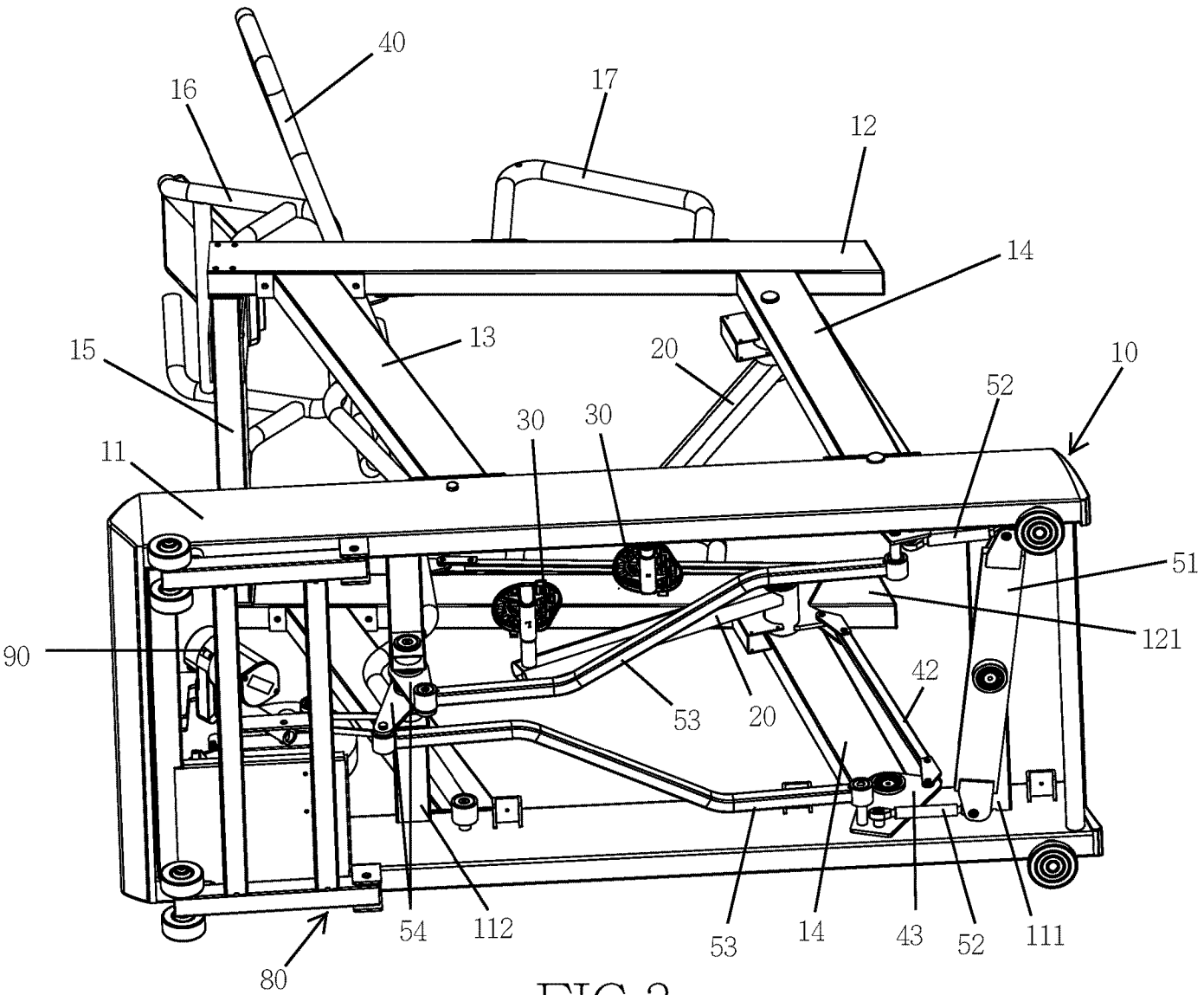
FIG. 3 is a bottom perspective view of the leg lift machine in accordance with the preferred embodiment of the present invention.
Figure 4:
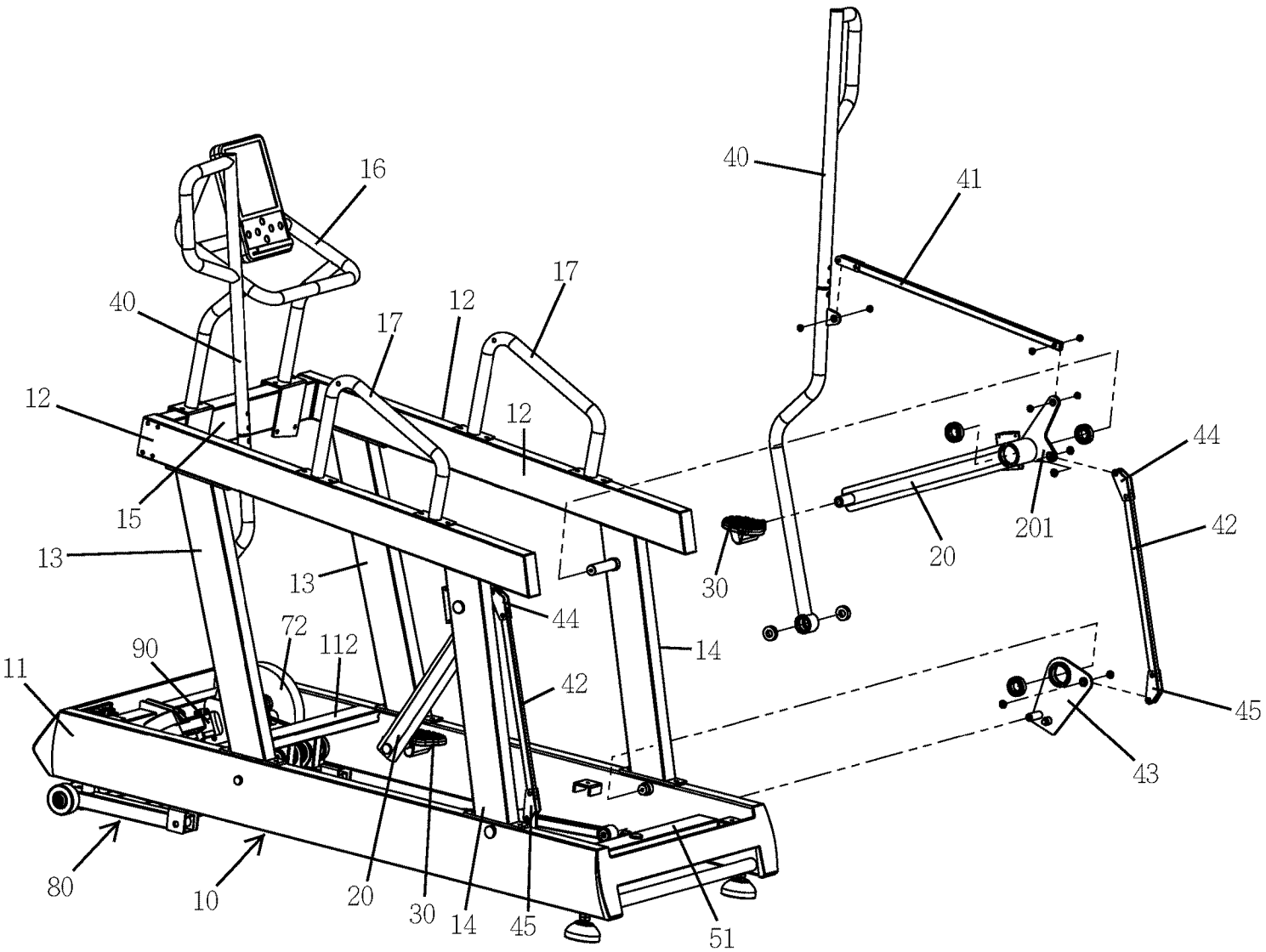
FIG. 4 is a partial exploded perspective view of the leg lift machine in accordance with the preferred embodiment of the present invention.
Figure 5:
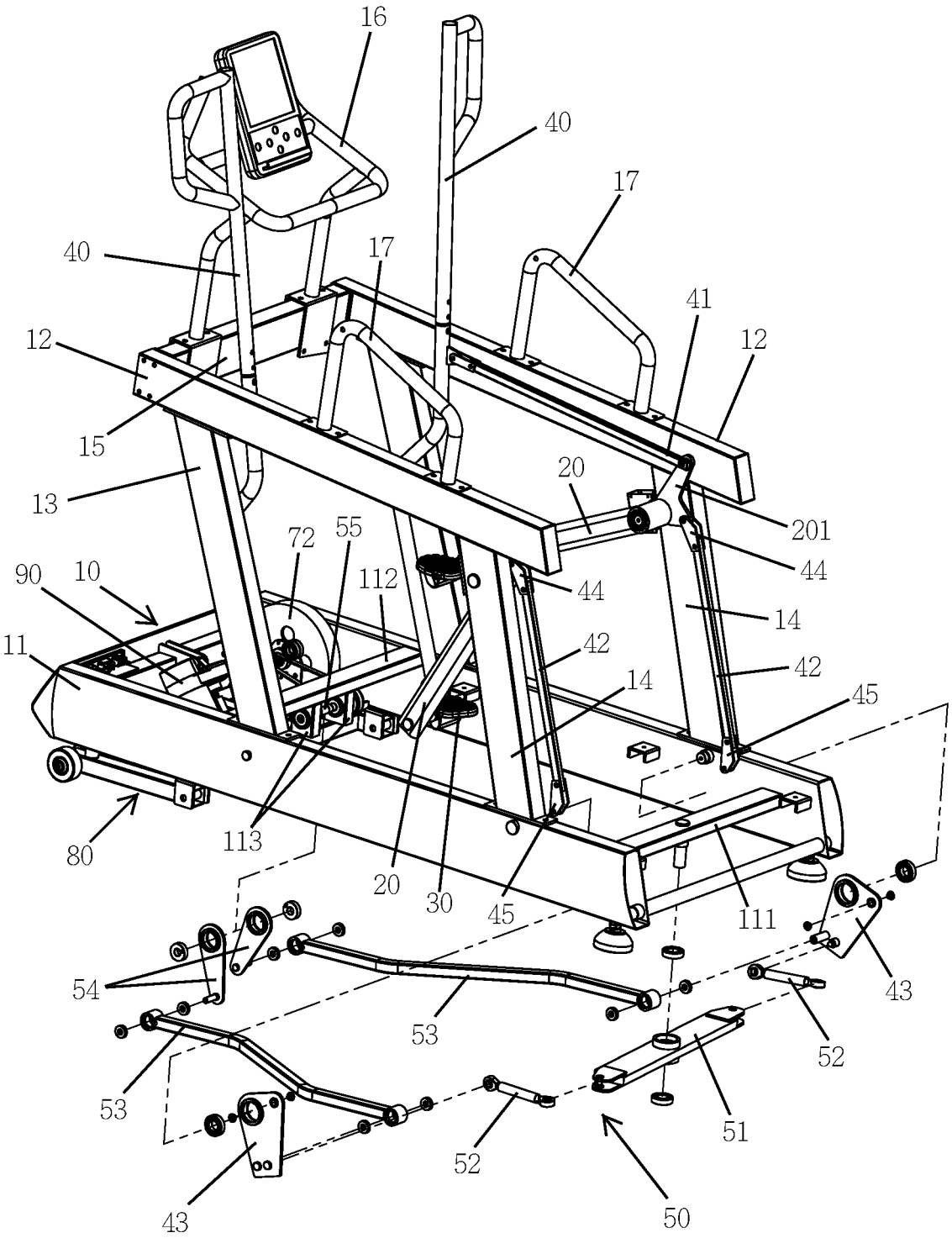
FIG. 5 is a partial exploded perspective view of the leg lift machine in accordance with the preferred embodiment of the present invention.
Figure 6:
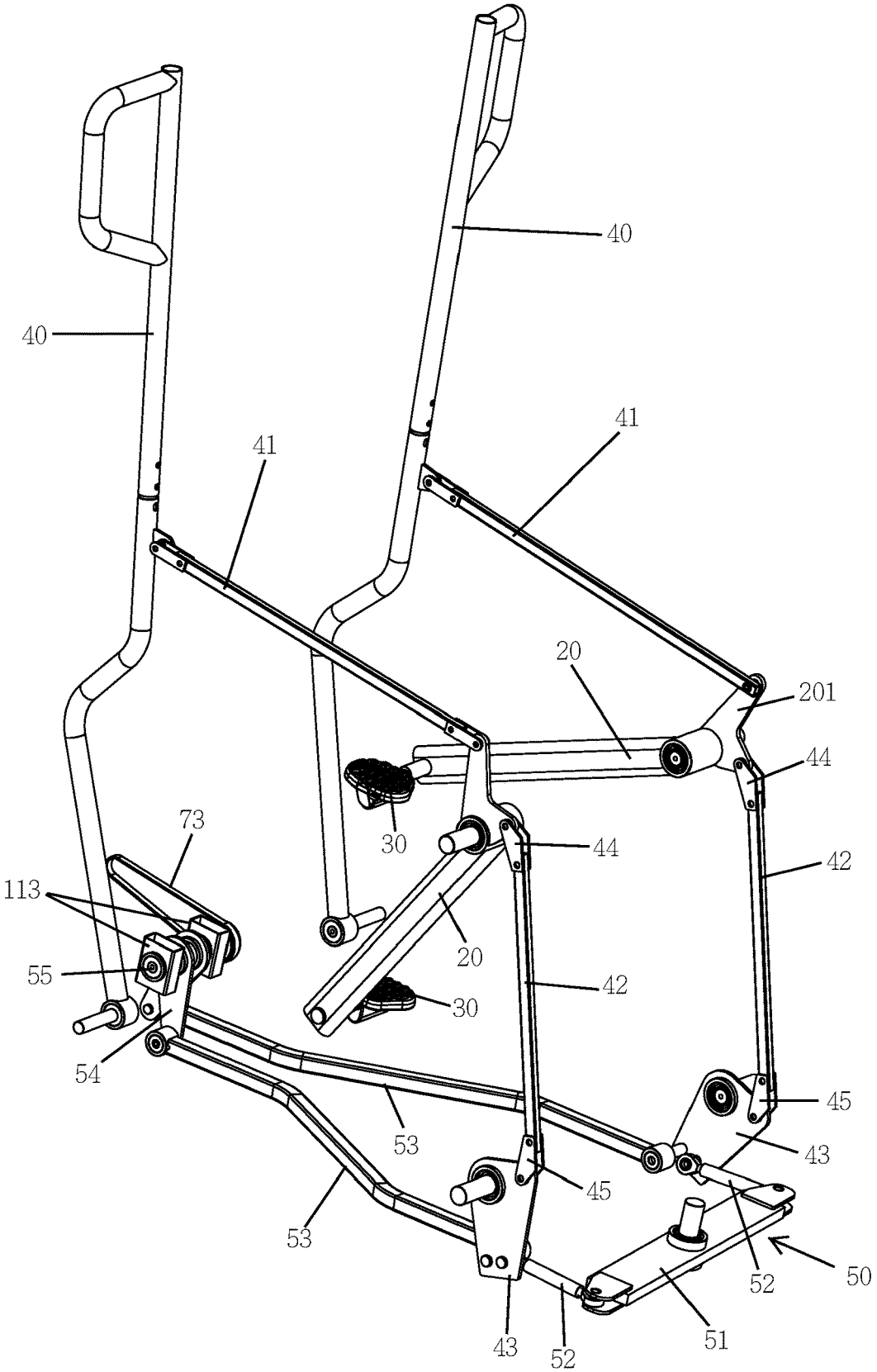
FIG. 6 is a partial perspective view of the leg lift machine in accordance with the preferred embodiment of the present invention.
Figure 7:
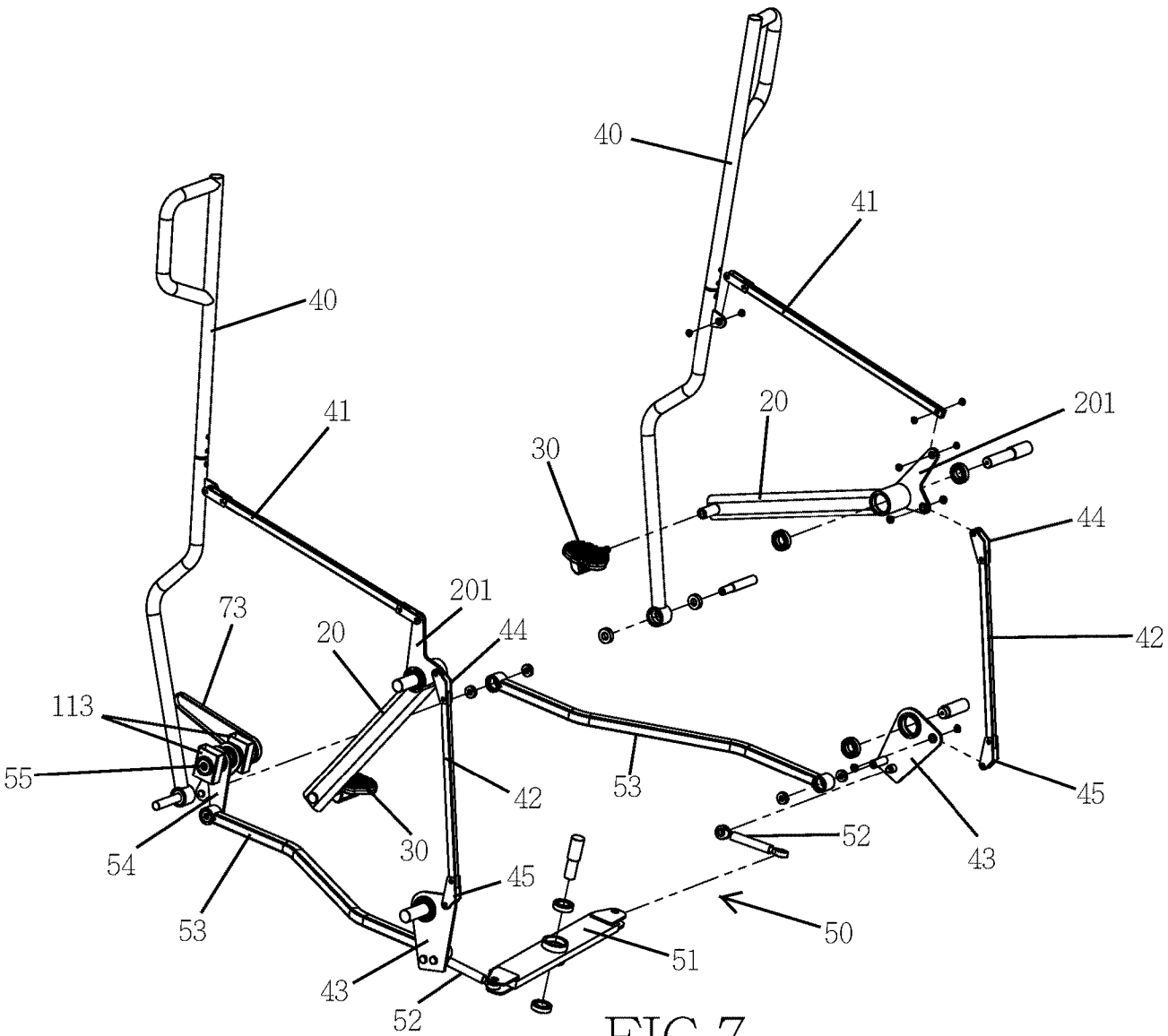
FIG. 7 is a partial exploded perspective view of the leg lift machine in accordance with the preferred embodiment of the present invention.
Figure 8:
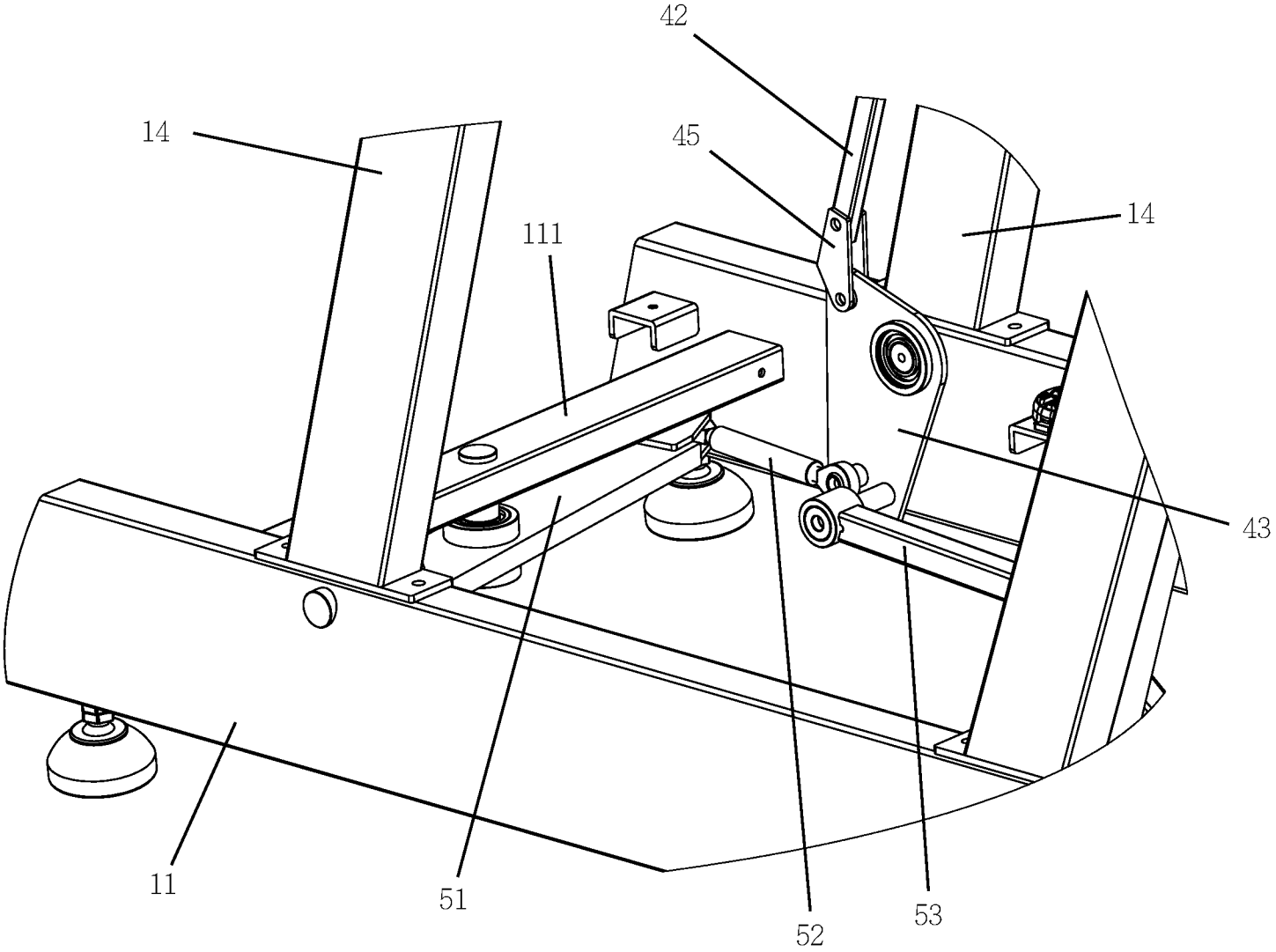
FIG. 8 is a locally enlarged perspective view of the leg lift machine in accordance with the preferred embodiment of the present invention.
Figure 9:
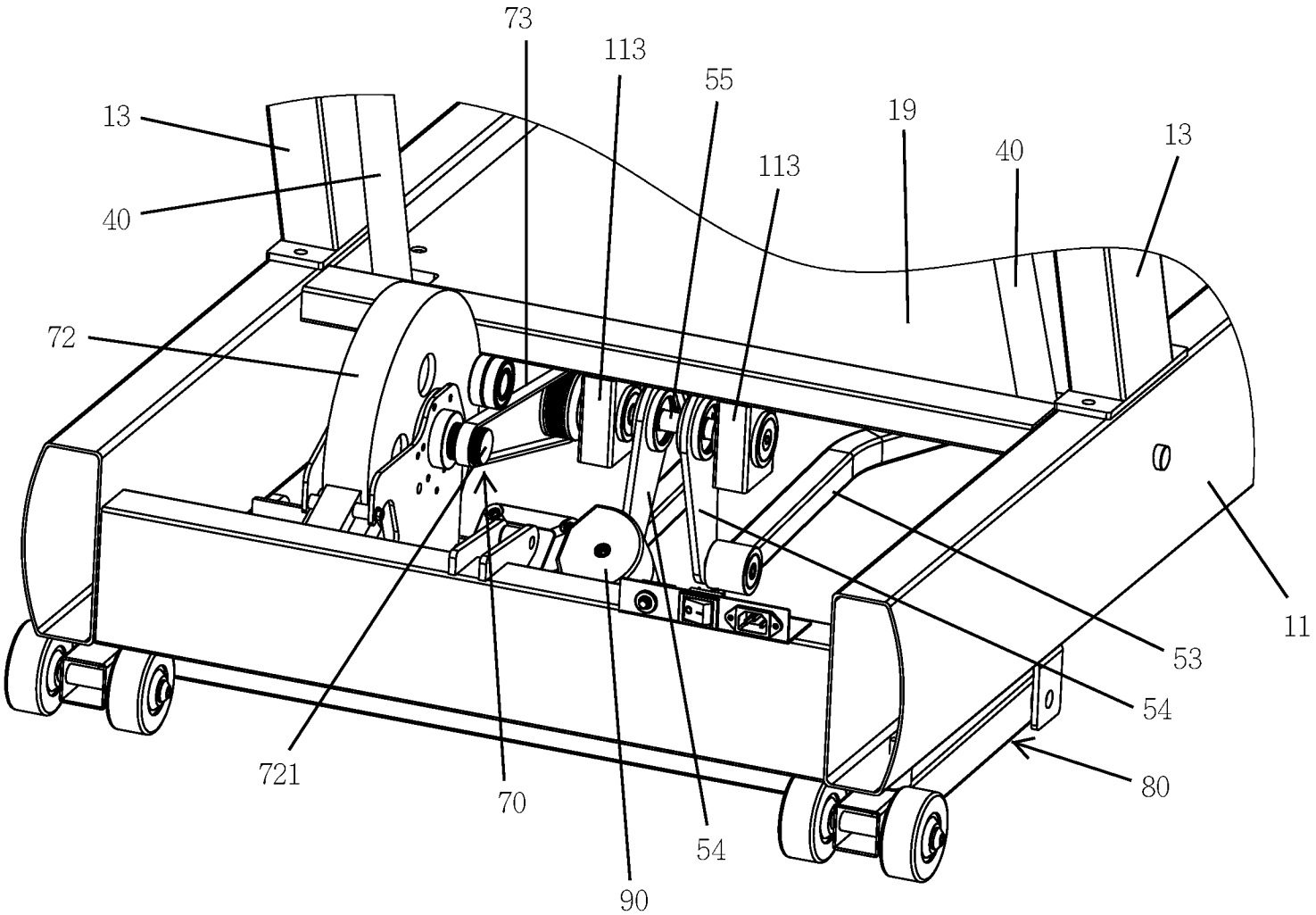
FIG. 9 is a locally enlarged perspective view of the leg lift machine in accordance with the preferred embodiment of the present invention.

Referring to the drawings and initially to FIGS. 1-3, a leg lift machine in accordance with the preferred embodiment of the present invention comprises a main frame unit 10, two drive levers 20, two pedals 30, two handlebars 40, two transverse driven levers 41, two first driven levers 42, two rear swinging members 43, a swinging mechanism 50, and a magnetically controlled resistance mechanism 70.

The main frame unit 10 includes a bottom frame 11, two side brackets 12, two front uprights 13, and two rear uprights 14. The two side brackets 12 are arranged above the bottom frame 11. Each of the two front uprights 13 is connected with the bottom frame 11 and a front end of one of the two side brackets 12. Each of the two rear uprights 14 is connected with the bottom frame 11 and a rear end of one of the two side brackets 12.

Each of the two drive levers 20 has an upper end provided with a pivot portion 201 extending outward. The upper end of each of the two drive levers 20 is pivotally mounted on one of the two rear uprights 14. Thus, the upper end of each of the two drive levers 20 is served as a rotation fulcrum, and the two drive levers 20 are pivoted relative to the main frame unit 10, reciprocally (or alternatingly) swing forward and backward, and move along a curved trajectory (or track).

Each of the two pedals 30 is pivotally mounted on a lower end of one of the two drive levers 20. Each of the two handlebars 40 has a lower end pivotally mounted on the bottom frame 11. Each of the two transverse driven levers 41 has a first end pivotally connected with a mediate section of one of the two handlebars 40 and a second end pivotally connected with the pivot portion 201 of one of the two drive levers 20. Each of the two first driven levers 42 has an upper end pivotally connected with the pivot portion 201 of one of the two drive levers 20. Each of the two rear swinging members 43 is pivotally mounted on one of the two rear uprights 14. Each of the two rear swinging members 43 has a first end pivotally connected with a lower end of one of the two first driven levers 42.

The swinging mechanism 50 includes a transverse swinging seat 51, two linking members 52, two bottom levers 53, two front swinging members 54, and a rotation mandrel 55. The transverse swinging seat 51 is swingably and pivotally mounted on a rear section of the bottom frame 11. Each of the two linking members 52 has a first end pivotally connected with one of two ends of the transverse swinging seat 51 and a second end pivotally connected with one of the two rear swinging members 43. Each of the two bottom levers 53 has a rear end pivotally connected with a second end of one of the two rear swinging members 43. Each of the two front swinging members 54 has a first end pivotally connected with a front end of one of the two bottom levers 53 and a second end mounted on the rotation mandrel 55. Preferably, a one-way (or unidirectional or single direction) bearing is mounted between each of the two front swinging members 54 and the rotation mandrel 55 so that when the two front swinging members 54 are pivoted respectively, the rotation mandrel 55 is rotated in one way.

The magnetically controlled resistance mechanism 70 is mounted on a front section of the bottom frame 11 and linked to the swinging mechanism 50 to provide a resistance to the swinging mechanism 50. The magnetically controlled resistance mechanism 70 at least includes a magnetically controlled wheel 72 that is rotatable, a pivot (or rotation) wheel 721 mounted on a shaft of the magnetically controlled wheel 72 and coaxial with the magnetically controlled wheel 72, and a transmission belt 73 mounted (or wound) around the pivot wheel 721 of the magnetically controlled wheel 72 and the rotation mandrel 55. The pivot wheel 721 and the rotation mandrel 55 are rotated synchronously by driving of the transmission belt 73.

In the preferred embodiment of the present invention, the main frame unit 10 further includes a front support 15 mounted between the two side brackets 12, a placement rack 16 mounted on the front support 15, and two hand grips 17 mounted on the two side brackets 12 respectively. Each of the two side brackets 12 has a front end connected with the front support 15.

In the preferred embodiment of the present invention, each of the two side brackets 12 is formed with a slot 121 extending longitudinally, and each of the two handlebars 40 passes through and is movable in the slot 121 of one of the two side brackets 12.

In the preferred embodiment of the present invention, the main frame unit 10 further includes two first covering members 122 respectively covering the two side brackets 12 and the two transverse driven levers 41, and two second covering members 141 respectively covering the two rear uprights 14. The slot 121 is formed in each of the two first covering members 122.

In the preferred embodiment of the present invention, the leg lift machine further comprises two first pivot pieces 44 and two second pivot pieces 45. Each of the two first pivot pieces 44 has a first end pivotally connected with the pivot portion 201 of one of the two drive levers 20 and a second end pivotally connected with the upper end of one of the two first driven levers 42. Each of the two second pivot pieces 45 has a first end pivotally connected with the lower end of one of the two first driven levers 42 and a second end pivotally connected with the first end of one of the two rear swinging members 43.

Preferably, each of the two second covering members 141 covers the pivot portion 201 of one of the two drive levers 20, one of the two first pivot pieces 44, one of the two first driven levers 42, and one of the two second pivot pieces 45.

In the preferred embodiment of the present invention, the main frame unit 10 further includes a front support strut 112 transversely mounted on the front section of the bottom frame 11, and two pivot ears 113 mounted on the front support strut 112. The two pivot ears 113 are parallel with each other. The rotation mandrel 55 is rotatably mounted on the two pivot ears 113. Thus, the two pivot ears 113 and the two front swinging members 54 co-pivot the rotation mandrel 55.

In the preferred embodiment of the present invention, the main frame unit 10 further includes a rear support strut 111 transversely mounted on the rear section of the bottom frame 11, and the transverse swinging seat 51 is pivotally mounted on the rear support strut 111.

In the preferred embodiment of the present invention, the main frame unit 10 further includes a front cover plate 18 covering the magnetically controlled resistance mechanism 70, and a rear cover plate 19 covering the swinging mechanism 50.

In the preferred embodiment of the present invention, the leg lift machine further comprises a swingable lifting rack (or lifting bracket or lifter) 80 pivotally mounted on a bottom of the bottom frame 11, and a lifting mechanism 90 mounted between the lifting rack 80 and the bottom frame 11. Thus, the lifting mechanism 90 drives the lifting rack 80 to swing relative to the bottom frame 11, to further adjust different inclined angles of the bottom frame 11.

In operation, referring to FIG. 1 with reference to FIGS. 2-9, the user stands on the two pedals 30, with his/her two hands holding the two handlebars 40 and two feet treading the two pedals 30. In such a manner, the two pedals 30 are stepped by the user to drive and move the two drive levers 20, so that the two drive levers 20 are pivoted relative to the main frame unit 10 freely. Thus, the two drive levers 20 will reciprocally swing forward and backward, and will move along a curved trajectory. Therefore, the user can raise legs to achieve an exercising effect.

When the two drive levers 20 are moved, each of the two transverse driven levers 41 is driven move one of the two handlebars 40 so that the two handlebars 40 will reciprocally swing forward and backward. At the same time, each of the two drive levers 20 in turn drives one of the two first pivot pieces 44, one of the two first driven levers 42, one of the two second pivot pieces 45, one of the two rear swinging members 43, one of the two bottom levers 53, and one of the two front swinging members 54, so that the two front swinging members 54 are pivoted respectively to drive and rotate the rotation mandrel 55.

When the rotation mandrel 55 is rotated in a single direction, the transmission belt 73 is driven to directly rotate the pivot wheel 721 which rotates the magnetically controlled wheel 72. Thus, when the magnetically controlled wheel 72 is rotated, the magnetically controlled wheel 72 feeds back the resistance to the two drive levers 20 and the two handlebars 40 in a one-stage transmission manner. Preferably, when the magnetically controlled wheel 72 is rotated relative to a magnetic bracket, the magnetic bracket provides a magnetic resistance to the magnetically controlled wheel 72 and to apply a damping force to the two drive levers 20 and the two handlebars 40, so that the user has to overcome the damping force to achieve an exercising effect.

Figure 10:
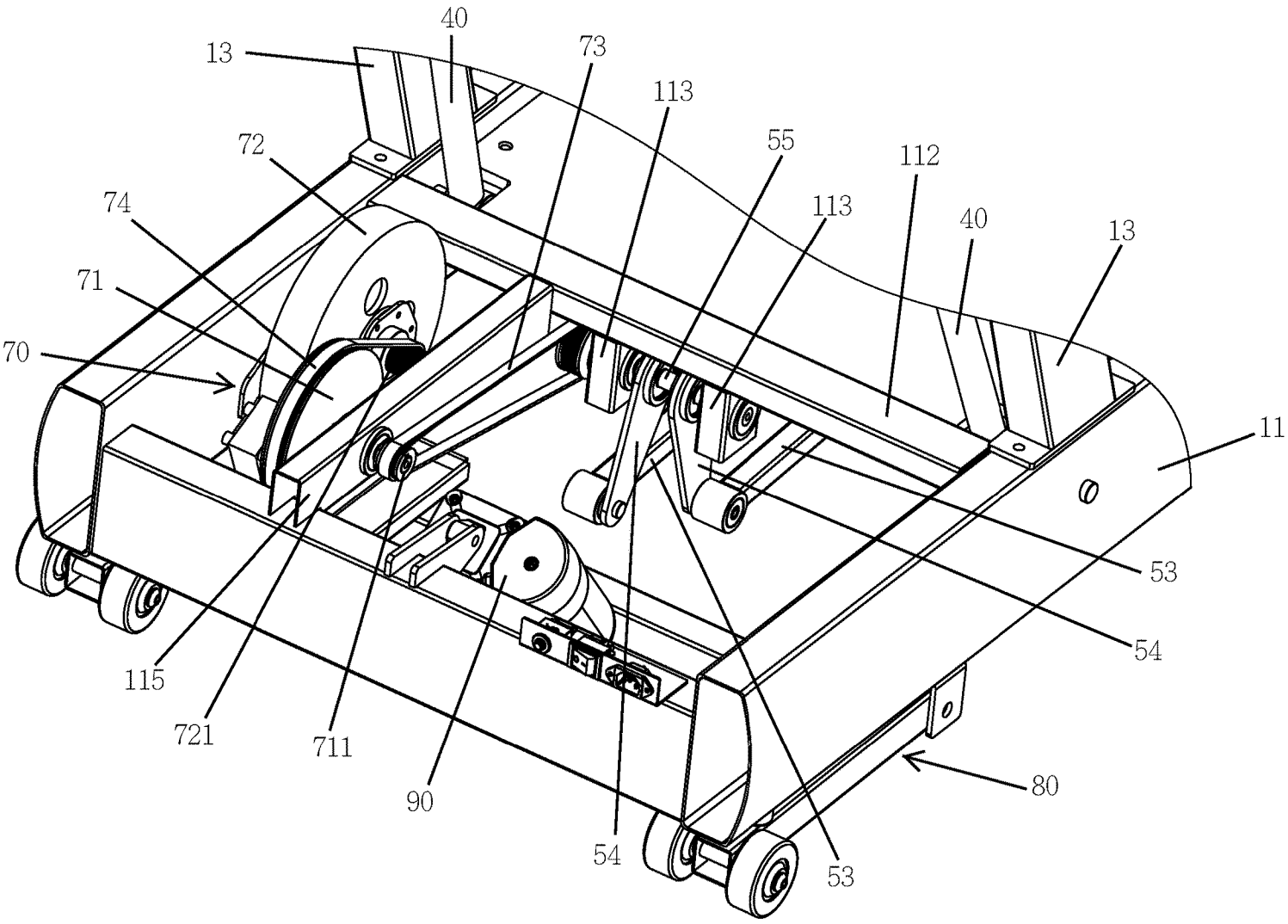
FIG. 10 is a locally enlarged perspective view of the leg lift machine in accordance with another preferred embodiment of the present invention.

Referring to FIG. 10, the main frame unit 10 further includes a pivot bracket 115 mounted on the front section of the bottom frame 11. The magnetically controlled resistance mechanism 70 further includes a belt wheel 71 that is rotatable, a second pivot (or rotation) wheel 711 mounted on a shaft of the belt wheel 71, and a second transmission belt 74 mounted (or wound) around the belt wheel 71 and the pivot wheel 721 of the magnetically controlled wheel 72. The belt wheel 71 and the second pivot wheel 711 are pivotally mounted on two sides of the pivot bracket 115. The transmission belt 73 is mounted around the second pivot wheel 711 of the belt wheel 71 and the rotation mandrel 55.

In operation, when the rotation mandrel 55 is rotated in a single direction, the transmission belt 73 is driven to directly rotate the second pivot wheel 711 which rotates the belt wheel 71 which drives the second transmission belt 74 which rotates the pivot wheel 721 which rotates the magnetically controlled wheel 72. Thus, when the magnetically controlled wheel 72 is rotated, the magnetically controlled wheel 72 feeds back the resistance to the two drive levers 20 and the two handlebars 40 in a two-stage transmission manner.

Accordingly, the leg lift machine of the present invention has the following advantages.

1. Each of the two handlebars 40 is limited to swing in the slot 121 of one of the two side brackets 12 so that the two handlebars 40 are moved smoothly and steadily. In addition, the two first covering members 122 respectively cover the two side brackets 12, and the two second covering members 141 respectively cover the two rear uprights 14, so that each of the two transverse driven levers 41, the pivot portion 201 of each of the two drive levers 20, each of the two first pivot pieces 44, each of the two first driven levers 42, and each of the two second pivot pieces 45 are operated without being exposed outward. Further, the front cover plate 18 covers the magnetically controlled resistance mechanism 70, and the rear cover plate 19 covers the swinging mechanism 50. Thus, many of the parts are hidden to prevent the user or other person from touching the parts, so that the user can operate the leg lift machine safely, and the leg lift machine has a clear appearance.

2. The transverse swinging seat 51, the two linking members 52, the two bottom levers 53, the two front swinging members 54, and the rotation mandrel 55 of the swinging mechanism 50 cooperate with the two transverse driven levers 41, the pivot portion 201 of each of the two drive levers 20, the two first pivot pieces 44, the two first driven levers 42, the two second pivot pieces 45, and the two rear swinging members 43, so that the swinging mechanism 50, the two handlebars 40, and the two drive levers 20 construct a frame-type linkage, to provide steady and exact swinging action and operation.

3. The lifting mechanism 90 drives and moves the lifting rack 80 to adjust different inclined angles of the main frame unit 10 when the user's two legs are lifted and lowered reciprocally and when the user's two arms swing reciprocally so that the user can exercise the core muscles with different training intensity.

4. The magnetically controlled resistance mechanism 70 provides a resistance or damping force to the two drive levers 20 and the two handlebars 40 in a one-stage or two-stage transmission manner. Preferably, the belt wheel 71 is designed to have different transmission ratios to diversify the resistance effect.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A leg lift machine comprising:

a main frame unit, two drive levers, two pedals, two handlebars, two transverse driven levers, two first driven levers, two rear swinging members, a swinging mechanism, and a magnetically controlled resistance mechanism;

wherein:

the main frame unit includes a bottom frame, two side brackets, two front uprights, and two rear uprights;

each of the two front uprights is connected with the bottom frame and a front end of one of the two side brackets;

each of the two rear uprights is connected with the bottom frame and a rear end of one of the two side brackets;

each of the two drive levers has an upper end provided with a pivot portion extending outward;

the upper end of each of the two drive levers is pivotally mounted on one of the two rear uprights;

the upper end of each of the two drive levers is served as a rotation fulcrum, and the two drive levers are pivoted relative to the main frame unit, reciprocally swingable forward and backward, and moveable along a curved trajectory;

each of the two pedals is pivotally mounted on a lower end of one of the two drive levers;

each of the two handlebars has a lower end pivotally mounted on the bottom frame;

each of the two transverse driven levers has a first end pivotally connected with a mediate section of one of the two handlebars and a second end pivotally connected with the pivot portion of one of the two drive levers;

each of the two first driven levers has an upper end pivotally connected with the pivot portion of one of the two drive levers;

each of the two rear swinging members is pivotally mounted on one of the two rear uprights;

each of the two rear swinging members has a first end pivotally connected with a lower end of one of the two first driven levers;

the swinging mechanism includes a transverse swinging seat, two linking members, two bottom levers, two front swinging members, and a rotation mandrel;

the transverse swinging seat is swingably and pivotally mounted on a rear section of the bottom frame;

each of the two linking members has a first end pivotally connected with one of two ends of the transverse swinging seat and a second end pivotally connected with one of the two rear swinging members;

each of the two bottom levers has a rear end pivotally connected with a second end of one of the two rear swinging members;

each of the two front swinging members has a first end pivotally connected with a front end of one of the two bottom levers and a second end mounted on the rotation mandrel;

the magnetically controlled resistance mechanism is mounted on a front section of the bottom frame and linked to the swinging mechanism to provide a resistance to the swinging mechanism; and the magnetically controlled resistance mechanism at least includes a magnetically controlled wheel that is rotatable, a pivot wheel mounted on a shaft of the magnetically controlled wheel, and a transmission belt mounted around the pivot wheel and the rotation mandrel.

2. The leg lift machine as claimed in claim 1, wherein the main frame unit further includes a front support mounted between the two side brackets, a placement rack mounted on the front support, and two hand grips mounted on the two side brackets, respectively, and the front end of each of the two side brackets is connected with the front support.

3. The leg lift machine as claimed in claim 1, wherein each of the two side brackets is formed with a slot extending longitudinally, and each of the two handlebars passes through and is movable in the slot of one of the two side brackets.

4. The leg lift machine as claimed in claim 3, wherein the main frame unit further includes two first covering members respectively covering the two side brackets, and two second covering members respectively covering the two rear uprights, and the slot is formed in each of the two first covering members.

5. The leg lift machine as claimed in claim 1, further comprising:

two first pivot pieces and two second pivot pieces;

wherein:

each of the two first pivot pieces has a first end pivotally connected with the pivot portion of one of the two drive levers and a second end pivotally connected with the upper end of one of the two first driven levers; and each of the two second pivot pieces has a first end pivotally connected with the lower end of one of the two first driven levers and a second end pivotally connected with the first end of one of the two rear swinging members.

6. The leg lift machine as claimed in claim 1, wherein:

the main frame unit further includes a front support strut transversely mounted on the front section of the bottom frame, and two pivot ears mounted on the front support strut;

the rotation mandrel is rotatably mounted on the two pivot ears; and the two pivot ears and the two front swinging members co-pivot the rotation mandrel.

7. The leg lift machine as claimed in claim 1, wherein the main frame unit further includes a rear support strut transversely mounted on the rear section of the bottom frame, and the transverse swinging seat is pivotally mounted on the rear support strut.

8. The leg lift machine as claimed in claim 1, wherein the main frame unit further includes a front cover plate covering the magnetically controlled resistance mechanism, and a rear cover plate covering the swinging mechanism.

9. The leg lift machine as claimed in claim 1, further comprising:

a swingable lifting rack pivotally mounted on a bottom of the bottom frame; and a lifting mechanism mounted between the swingable lifting rack and the bottom frame;

wherein:

the lifting mechanism drives the swingable lifting rack to swing, to further adjust different inclined angles of the bottom frame.

10. The leg lift machine as claimed in claim 1, wherein:

the main frame unit further includes a pivot bracket mounted on the front section of the bottom frame;

the magnetically controlled resistance mechanism further includes a belt wheel that is rotatable, a second pivot wheel mounted on a shaft of the belt wheel, and a second transmission belt mounted around the belt wheel and the pivot wheel of the magnetically controlled wheel;

the belt wheel and the second pivot wheel are pivotally mounted on two sides of the pivot bracket; and the transmission belt is mounted around the second pivot wheel and the rotation mandrel.

* * * * *